US005460753A

United States Patent [19]

Holdar

[11] Patent Number: 5,460,753

[45] Date of Patent: Oct. 24, 1995

[54] AQUEOUS CLEANING COMPOSITION FOR PARTS WASHERS

[75] Inventor: Robert M. Holdar, Irving, Tex.

[73] Assignee: NCH Corporation, Irving, Tex.

[21] Appl. No.: 60,235

[22] Filed: May 10, 1993

[51] Int. Cl.[6] ..... C11D 1/34; C11D 1/83; C11D 3/30

[52] U.S. Cl. ..... 252/544; 252/174.16; 252/174.21; 252/174.22; 252/525; 252/173; 252/DIG. 17

[58] Field of Search ..... 252/544, 174.16, 252/174.21, 174.22, DIG. 17, 525, 173

[56] References Cited

U.S. PATENT DOCUMENTS

| | | | |
|---|---|---|---|
| 4,135,878 | 1/1979 | Bishop et al. | 8/139 |
| 4,360,061 | 11/1982 | Canter et al. | 166/274 |
| 4,438,024 | 3/1984 | Del Greco et al. | 252/545 |
| 4,675,124 | 6/1987 | Seiter et al. | 252/91 |
| 4,743,395 | 5/1988 | Leifheit | 252/106 |
| 4,853,146 | 8/1989 | Rorig et al. | 252/142 |
| 4,861,502 | 8/1989 | Caswell | 252/8.75 |
| 4,869,836 | 9/1989 | Harmalker | 252/8.8 |

*Primary Examiner*—Paul Lieberman
*Assistant Examiner*—Erin M. Harriman
*Attorney, Agent, or Firm*—Ross, Clapp, Korn & Montgomery

[57] ABSTRACT

Aqueous cleaning compositions comprising phosphate esters, ethoxylated amines having five or more moles of ethoxylation, or optionally, an ethoxylated alcohol or ethoxylated alkyl phenol.

6 Claims, No Drawings

AQUEOUS CLEANING COMPOSITION FOR PARTS WASHERS

BACKGROUND OF THE INVENTION

1. Field of the Invention

This invention relates to chemical formulations which are useful as aqueous cleaning compositions for the removal of oily or greasy soils. These formulations demonstrate as a second useful characteristic the spontaneous separation of such oil or grease from the used aqueous cleaning composition allowing further use or disposal of said aqueous cleaning compositions.

2. Description of Related Art

Cleaning compositions consisting of various solvents or their mixtures with each other and/or with various other additives are widely used for removing oily or greasy soils from various substrates. These compositions are typically characterized by various disadvantages such as flammability, toxicity, carcinogenicity and other regulatory concerns which limit their use and subsequent disposal.

Prior patents disclosing the use of ethoxylated amines, ethoxylated alcohols and/or phosphate esters in cleaning, conditioning or emulsifying agents include, for example: U.S. Pat. Nos. 4,360,061; 4,675,124; 4,743,395; 4,853,146; 4,861,502; and 4,869,836.

U.S. Pat. No. 4,360,061 discloses polymer-microemulsion complexes in which the polymer is complexed with the surfactant in the emulsion, and a method of using the complexes for the secondary and tertiary recovery of crude oil. The use of anionic, nonionic and cationic surfactants is disclosed, with phosphate esters, ethoxylated amines, ethoxylated alcohols and ethoxylated alkyl phenols being identified as acceptable surfactants.

U.S. Pat. No. 4,675,124 discloses a granular detergent generally used for laundry applications that contains ethoxylated primary alcohol, ethoxylated alkylamine, and an anionic surfactant. Ethoxylated alkylamines containing on average from one to three glycolether groups are preferred.

U.S. Pat. No. 4,743,395 discloses a thickened acid cleaner designed especially for cleansing and sanitizing porcelain, ceramic and tile surfaces bearing residues of lime soaps and mineral deposits. The use of an ethoxylated tertiary amine having from one to three moles of ethoxylation as a thickening agent and the use of another having from two to five moles of ethoxylation as a phase stabilizing agent are disclosed. Ethoxylated octyl or nonyl phenol are disclosed as optional phase stabilizing agents. U.S. Pat. No. 4,853,146 discloses similar compositions.

U.S. Pat. No. 4,861,502 discloses fabric conditioning agents and fabric care compositions containing such agents. Ethoxylated monoamines are disclosed for use as clay soil removal and antideposition agents; ethoxylated alcohols and ethoxylated alkyl phenols are disclosed as detergent surfactants and builders.

U.S. Pat. No. 4,869,836 discloses through-the-wash fabric conditioning compositions which provide softening and antistatic benefits to laundered fabrics. An ethoxylated alcohol is disclosed for use as an emulsifying agent for the tertiary amine-multifunctional carboxylic acid complex of the compositions.

None of the foregoing references discloses any appreciation of the benefits achievable through use of phosphate esters in combination with ethoxylated amines having five or moles of ethoxylation, and optionally, an ethoxylated alcohol or ethoxylated alkyl phenol, in aqueous cleaning compositions suitable for use in parts washers. Such compositions are disclosed herein.

SUMMARY OF THE INVENTION

The compositions of the invention are intended to provide a safer working environment for the user while maintaining effective cleaning performance and minimizing the impact on the general environment upon disposal. More particularly, the present invention provides a cleaning solution which, after having removed an oily soil from the item to be cleaned, allows that soil to spontaneously separate from the used solution. This desirable feature maintains the cleanliness of the cleaning solution and thereby extends its useful life. The compositions of the invention are nonflammable and also have a low order of toxicity.

According to one embodiment of the invention, an aqueous cleaning composition is provided that comprises a mixture of an anionic phosphate ester and an ethoxylated alkyl amine having five or more moles of ethoxylation. According to a particularly preferred embodiment of the invention, the ethoxylated alkyl amine comprises more than five, and most preferably, up to about 15 moles of ethoxylation. The ratio of phosphate ester to ethoxylated amine in the compositions of the invention preferably ranges from about 1:2 to about 2:1 by weight. The detergent composition made using the mixture of phosphate ester and ethoxylated amine is preferably diluted in a ratio of about three parts water to one part detergent prior to use.

According to another embodiment of the invention, ethoxylated alcohols or ethoxylated phenols are substituted for all or part of the ethoxylated amine in the subject cleaning compositions.

DESCRIPTION OF THE PREFERRED EMBODIMENTS

The parts washing composition of the invention preferably comprises a mixture of an anionic phosphate ester and an ethoxylated alkyl amine along with suitable builders and bases to adjust the pH of the mixture to a substantially neutral value. Polyphosphate salts have been found to be superior builders for use with this invention. Suitable corrosion inhibitors and co-surfactants may also be added to the mixture as desired.

The subject compositions preferably comprise an ethoxylated alkyl amine and a phosphate ester of an ethoxylated alkyl phenol in a ratio of from about 1:2 to about 2:1 by weight. Ethoxylated alkyl amines having longer alkyl chains have been found to perform better than those with shorter alkyl chains, and those more ethylene oxide units work better than those with fewer. The compositions of the invention preferably comprise ethoxylated alkyl amines having five or more moles of ethoxylation, and most preferably, about 15 moles of ethoxylation. In particular, a POE 15 tallow amine has been found to provide better cleaning than a POE 15 coco amine and a POE 10 soya amine has been found to provide better cleaning than a POE 5 soya amine.

A number of anionic phosphate esters have been found to be useful in this invention. Of particular use are several derived from ethoxylated alkyl phenols. These proprietary phosphate esters are available under several trade names such as Monafax®(Mona Industries), Maphos®(PPG), Dephos®(DeForest) and Gafac®(GAF).

Alternatively, functionally comparable nonionic surfactants such as ethoxylated alcohols or ethoxylated phenols can be substituted for all or part of the ethoxylated amine in the compositions of the invention. In general, those with a lower HLB provide better removal of oily soil at the expense of better oil separation from the used solvent.

In the preferred embodiment of the invention it has been found that the choice of base has a significant effect on the cleaning ability and oil separation. In particular, diethanol amine or morpholine provides better removal of an oily soil than triethanol amine, which in turn is better, for example, than monoethanol amine or AMP 95. In contrast, monoethanol amine provides better oil separation than triethanol amine, which is better than morpholine and much better than AMP 95.

The compositions of the invention and the method of making them are further described and explained in the examples set forth below:

EXAMPLE 1

Fifteen parts of the condensation product of fifteen moles of ethylene oxide with one mole of tallow amine are mixed with fourteen parts of a proprietary phosphate ester of an ethoxylated alkyl phenol sold under the trade name Monafax®057. To this mix is added two parts of diethanolamine. Sixty-five parts of water are added and the mixture is stirred until clear and uniform. Four parts of sodium tripolyphosphate are then dissolved in the mixture to obtain a clear amber detergent solution.

To evaluate the detergent solution, mild steel panels are soiled with a mixture of used motor oil, clay, carbon black, red iron oxide and fine silica sand. One part of the detergent solution is added to three parts of water in a beaker equipped with a magnetic stirrer. A soiled panel is suspended in the detergent solution, which is then stirred at room temperature for thirty minutes. The panel is removed and rinsed in tap water. Essentially all soil is removed from the portion which had been immersed in the detergent solution.

EXAMPLE 2

Six parts of the ethoxylated tallow amine in Example 1 are mixed with fourteen parts of Monafax®057 and nine parts of the condensation product of three moles of ethylene oxide with one mole of a mixture of $C_{12}$ to $C_{15}$ alcohols sold under the name Neodol®25–3. The detergent is completed with two parts of diethanolamine, sixty-five parts of water and four parts of sodium tripolyphosphate as in Example 1 above.

When evaluated as in Example 1 above, essentially all of the soil is removed from the immersed portion of the panel.

OIL SEPARATION

Ten parts of used motor oil is then added to mixtures of each of the two detergents made according to Examples 1 and 2 above, which are diluted with three parts water to one part detergent. Each oil, water and detergent mixture is well mixed and allowed to stand overnight in separatory funnels. The used detergent solution is then drawn off from the separated oil. Fat, oil and grease content are determined for each of the used and unused detergent solutions.

The detergent from Example 1 contains 67 parts per million fat, oil and grease in the unused sample and 137 parts per million in the used sample. The detergent from Example 2 contains 1933 ppm in the unused detergent and 5066 ppm in the used sample.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

I claim:

1. A wholly aqueous non-flammable, low order of toxicity detergent composition consisting essentially of a mixture of an ethoxylated alkyl amine having five or more moles of ethoxylation, an anionic phosphate ester wherein the ratio of ethoxylated alkyl amine to phosphate ester ranges from about 1:2 to about 2:1, sufficient base to adjust the detergent to a substantially neutral pH and optionally a builder wherein said detergent composition is diluted in a ratio of three parts water to one part detergent composition.

2. The detergent composition of claim 1 wherein the ethoxylated alkyl amine is ethoxylated tallow amine.

3. The detergent composition of claim 1 wherein the phosphate ester is the phosphate ester of an ethoxylated alkyl phenol.

4. The detergent composition of claim 2 wherein a condensation product of three moles of ethylene oxide with one mole of a mixture of $C_{12}$ to $C_{15}$ alcohols is substituted for part of the ethoxylated tallow amine.

5. The detergent composition of claim 1 wherein the base is selected from the group consisting of diethanolamine and morpholine.

6. The detergent composition of claim 1 further consisting essentially of a minor amount of a builder that is a polyphosphate salt.

* * * * *